United States Patent [19]

Tsai

[11] Patent Number: 5,008,970

[45] Date of Patent: Apr. 23, 1991

[54] SCRAPER HAVING A HAND GRIP CONSTRUCTION

[76] Inventor: Su J. Tsai, No. 1, Lane 15-2, Yung Feng Rd., Tai Ping Hsiang, Taichung Hsien, Taiwan

[21] Appl. No.: 468,159

[22] Filed: Jan. 22, 1990

[51] Int. Cl.[5] ..... A47L 13/022; B26B 3/00

[52] U.S. Cl. ..... 15/236.01; 15/143 R; 16/110 R; 30/169; 30/340; 81/489; 273/73 J

[58] Field of Search ..... 15/143 R, 236.01, 236.02, 15/236.07, 235.4, 235.5; 30/169, 340, 342, 343, 344; 16/110 R, 110 A; 81/489; 76/106; 273/73 J

[56] References Cited

U.S. PATENT DOCUMENTS 4,524,514 6/1985 Mallalieu ..... 30/169

4,794,694 1/1989 Daniel et al. ..... 15/236.01

FOREIGN PATENT DOCUMENTS 255137 10/1964 Australia ..... 15/235.4

2458764 6/1975 Fed. Rep. of Germany .... 16/110 R

*Primary Examiner*—Edward L. Roberts

*Attorney, Agent, or Firm*—Steinberg & Raskin

[57] ABSTRACT

A scraper includes a blade fixed in a front end of a handle. Two covers, each with two retainers and a clamping device are respectively provided on an upper surface and a lower surface of the handle. The retainers and the clamping device of one cover pass through the handle and engage with the respective retainers and the clamping device of another cover so that the two covers are easily clamped together. The two covers are provided to form a smooth outer surface for the handle.

3 Claims, 3 Drawing Sheets

SCRAPER HAVING A HAND GRIP CONSTRUCTION

BACKGROUND OF THE INVENTION

The present invention relates to a scraper, and more particularly to a scraper having a hand grip construction.

Tool having a hand grip construction is disclosed in U.S. Pat. No. 3,018,497, (filed 14 Dec. 1959, Ser. No. 859,332, "Tool Having a Hand Grip Construction"). The tool includes two shells 2 and two inserts 30 secured together by rivets 44, 46, 48. This requires additional tools for securing the rivets.

Another type of knife is disclosed in U.S. Pat. No. 4,794,694, (filed 1 Feb. 1988, Ser. No. 150,831, "Broad Putty Knife with Snap-On Tang"). The knife includes butterfly clips 80, 86, 89 for securing purposes. The construction thereof is complicate and is difficult for manufacturing purposes.

The present invention has arisen to mitigate and/or obviate the afore-described disadvantages of the conventional scrapers.

SUMMARY OF THE INVENTION

The primary objective of the present invention is to provide a scraper having a hand grip construction which can be easily assembled without additional tools.

In accordance with one aspect of the invention, there is provided a scraper which includes a blade being fixed in a front end of a handle. The handle includes a plate and an outer perimeter wall is respectively formed on an upper surface and a lower surface of the plate. Two holes and an opening are formed in the plate. Two covers, each with two retainers and a clamping device are respectively provided on an upper surface and a lower surface of the handle. One or more teeth are formed on each retainer. The retainers are inserted into the respective holes so that the teeth are engaged with one another. The free ends of the clamping devices are engaged with each other. The covers are provided to form a smooth outer surface for the handle.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
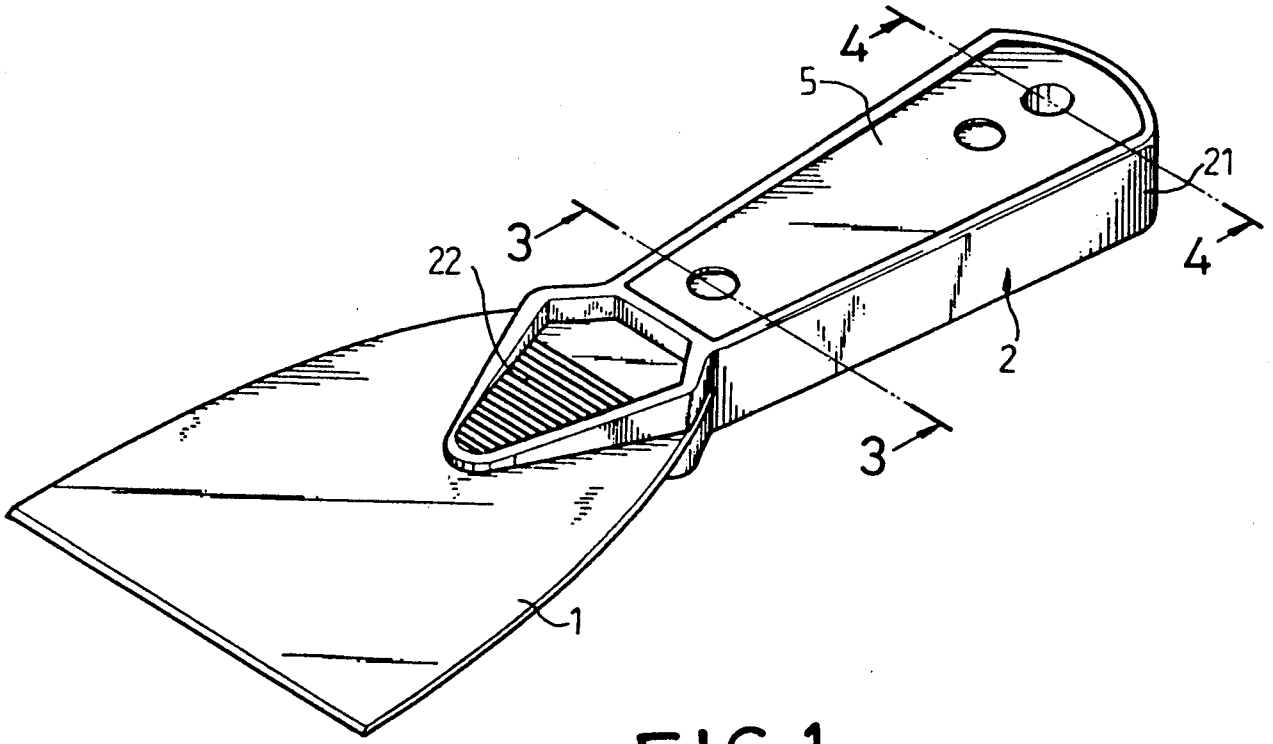
FIG. 1 is a perspective view of a scraper in accordance with the present invention.

Referring to the drawings and initially to FIG. 1, the scraper having a hand grip construction in accordance with the present invention comprises generally a blade 1, a molded handle 2 and two covers 5 clamped together on the upper end and the lower end of the molded handle 2.

Figure 2:
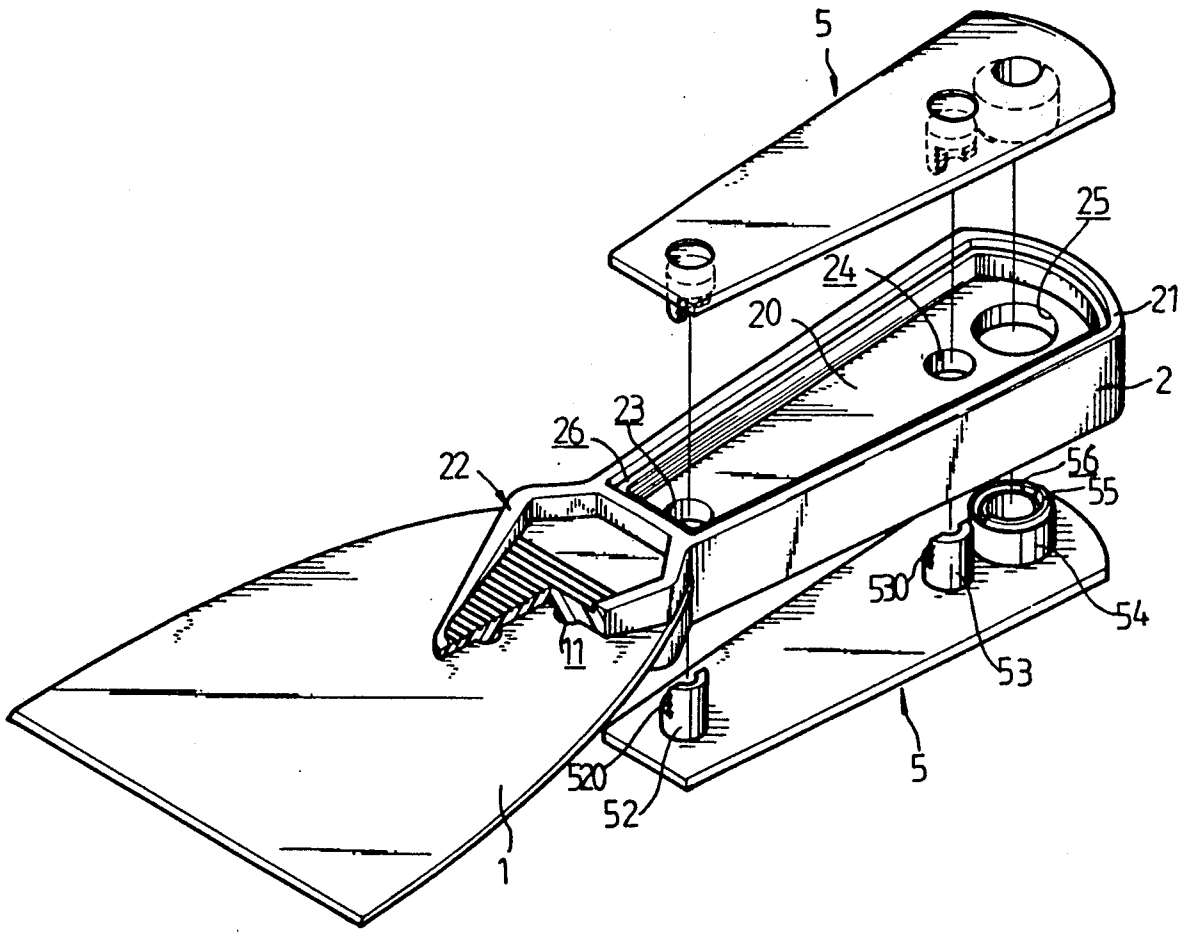
FIG. 2 is an exploded view of the scraper of FIG. 1.

Referring next to FIG. 2, a plurality of holes 11 are formed in the rear end of the blade 1 so that the blade 1 and the front portion 22 of the handle 2 are rigidly molded together. The handle 2 substantially comprises a plate 20 and an outer perimeter wall 21 formed on an upper surface and a lower surface thereof. Two holes 23, 24 and an opening 25 are formed in the plate 20 in which the opening 25 in the rear end of the plate 20 is preferably larger in diameter than the two holes 23, 24. A perimeter recess 26 is formed in the upper and inner surface of each perimeter wall 21.

The two covers 5 are substantially identical in shape and each has a shape corresponding to the recess 26 of the perimeter wall 21. The recess 26 and the cover 5 are arranged such that the cover 5 is rested in the recess 26 in order to form a smooth outer surface for the handle 2. Two retainers 52, 53 and a clamping device 54 are provided on the cover 5 and are arranged in accordance with the holes 23, 24 and the opening 25 of the plate 20 of the handle 2. Each of the retainers 52, 53 is substantially cylindrical with a semi-circular portion formed on a free end thereof. The semi-circular portion is substantially located on one side of a longitudinal axis of the cover 5. A plurality of teeth 520, 530 are formed on the end surfaces of each semi-circular portion, best shown in FIG. 3. The clamping device 54 is substantially a cylinder. A semi-circular protrusion 55 and a semi-circular groove 56 are formed on an upper surface of the clamping device 54 and are separated by the longitudinal axis of the cover 5.

Figure 4:
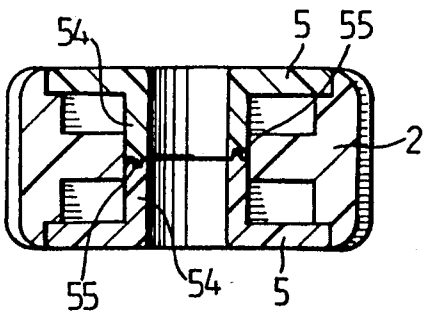
FIG. 4 is a lateral cross sectional view taken along lines 4—4 in FIG. 1.
Figure 3:
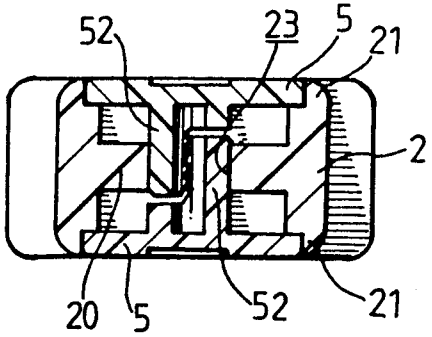
FIG. 3 is a lateral cross sectional view taken along lines 3—3 in FIG. 1.

Referring next to FIGS. 3 and 4, one cover 5 is provided on the upper end and one cover 5 is provided on the lower end of the handle 2. Each cover 5 is rested in the perimeter recess 26 of each perimeter wall 21. The retainers 52 and 53 are respectively inserted into the holes 23 and 24 so that the teeth 520 of the two retainers 52 are engaged with one another and the teeth 530 of the two retainers 53 are engaged with one another. Each clamping device 54 extends substantially half way through the opening 25 when the covers 5 are disposed on the handle 2. The semi-circular protrusion 55 of one of the clamping device 54 is engaged with the semi-circular groove 56 of the other clamping device. The two covers 5 are retained together by the retainers 52, 53 and are further clamped together by the clamping devices 54. The two covers 5 provide a smooth outer surface for the handle 2 so that users may feel comfortable.

Accordingly, the scraper having a handle grip construction in accordance with the present invention has the following advantages:

(1) the covers 5 can be easily clamped together by the clamping devices 54 and the retainers 52, 53 without additional tools so that a productivity thereof is increased; and (2) the covers 5 are identical in shape so that they can be molded or produced by the same one and only one mold, this is good for manufacturing purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A scraper comprising a blade being fixed in a front end of a handle; said handle substantially comprising a plate, an outer perimeter wall being respectively formed on an upper surface and a lower surface of said plate, at least one hole being formed in said plate; an upper cover and a lower cover having a shape corresponding to that of said handle and being respectively provided on an upper surface and a lower surface of said outer perimeter wall of said handle, at least one retainer being formed on one surface of each said cover and being arranged in accordance with said hole of said plate, a semi-circular portion being formed on a free end of each said retainer and being located on one side of a longitudinal axis of each said cover, a plurality of teeth being formed on an end surface of said semi-circular portion of each said retainer, and said semi-circular portion of each said retainer of said upper cover and a corresponding semi-circular portion of each said retainer of said lower cover being inserted into said at least one hole so that said teeth thereof are engaged with one another and so that said covers are clamped together in order to form a smooth outer surface for said handle.

2. A scraper according to claim 1, wherein an opening is formed in said plate; a clamping device is formed on each said cover and is located on the same side of said cover as said retainer, said clamping device is substantially a cylinder with a semi-circular protrusion and a semi-circular groove formed on a free end thereof, each said clamping device extends half way through said opening, said semi-circular protrusion and said semi-circular groove are separated by said longitudinal axis of each said cover, and said semi-circular protrusion of one of said clamping device is engaged with said semi-circular groove of an other clamping device.

3. A scraper according to claim 1, wherein a perimeter recess is formed in an inner surface of the outer end of each said perimeter wall of said handle, said covers are rested in a respective perimeter recess of said perimeter walls so that a smooth outer surface of said handle is formed.

* * * * *